US006827631B2

(12) United States Patent
Tomotaki et al.

(10) Patent No.: US 6,827,631 B2
(45) Date of Patent: Dec. 7, 2004

(54) CENTER SUPPORT GRINDING METHOD, CENTER SUPPORT GRINDING MACHINE, AND CENTERING METHOD FOR THE CENTERS THEREOF

(75) Inventors: Katsura Tomotaki, Chiba (JP); Yukimasa Nakamura, Chiba (JP)

(73) Assignee: Seiko Instruments Inc., Chiba (JP)

( * ) Notice: Subject to any disclaimer, the term of this patent is extended or adjusted under 35 U.S.C. 154(b) by 0 days.

(21) Appl. No.: 10/320,096

(22) Filed: Dec. 16, 2002

(65) Prior Publication Data

US 2003/0232584 A1 Dec. 18, 2003

(30) Foreign Application Priority Data

Dec. 17, 2001 (JP) ..... 2001-383591
Nov. 25, 2002 (JP) ..... 2002-341369

(51) Int. Cl.[7] ..... B24B 49/00

(52) U.S. Cl. ..... 451/11; 451/243; 451/246; 451/231; 82/18; 82/148; 409/165

(58) Field of Search ..... 451/49, 58, 243, 451/231, 246, 11, 51; 409/165, 166, 198, 199; 82/18, 148

(56) References Cited

U.S. PATENT DOCUMENTS 4,331,452 A * 5/1982 Causey et al. ..... 451/67
4,538,945 A * 9/1985 Godecke et al. ..... 409/157
4,553,885 A * 11/1985 Kovari et al. ..... 409/201
5,299,388 A * 4/1994 Bishop ..... 451/227
5,525,092 A * 6/1996 Hirano et al. ..... 451/5
6,283,837 B1 * 9/2001 Vorbuchner ..... 451/58
6,431,954 B1 * 8/2002 Junker ..... 451/11
6,450,865 B2 * 9/2002 Mulroy et al. ..... 451/49

* cited by examiner

*Primary Examiner*—George Nguyen
(74) *Attorney, Agent, or Firm*—Adams & Wilks

(57) ABSTRACT

To provide a grinding machine and a centering method for the centers thereof in which the requisite space for the center support rotating mechanism for a workpiece and the in-feed mechanism is reduced to facilitate miniaturization and in which it is easy to secure the space for the supply and discharge of the workpiece and sizing measurement. A motor built-in type main spindle retaining a rotary drive center and a motor built-in type tailstock spindle retaining a tailstock center are swiveled by in-feed means eccentrically supporting them, whereby the rotary drive center and the tailstock center make an in-feed motion with respect to a grinding wheel.

9 Claims, 10 Drawing Sheets

CENTER SUPPORT GRINDING METHOD, CENTER SUPPORT GRINDING MACHINE, AND CENTERING METHOD FOR THE CENTERS THEREOF

FIELD OF THE INVENTION

This invention relates to a center support grinding method, a center support grinding machine, and a centering method for centers thereof in which a cylindrical workpiece to be subjected to outer diameter machining is held by the two centers and fed to a grinding wheel while being rotated, in particular, to a center support grinding method, a center support grinding machine, and a centering method for centers thereof which are suitable for the grinding of the peripheral surface of a cylindrical workpiece with a small diameter and in which it is easy to miniaturize the grinding machine for grinding per se.

DESCRIPTION OF THE PRIOR ART

In the grinding of the cylindrical surface of a cylindrical workpiece of minute size, for example, in the grinding of the cylindrical surface of a Zr ferrule for an optical connector, an optical fiber insertion hole of 0.125 mm is formed at the center of a cylinder with an outer diameter of 2.5 mm to 1.25 mm concentrically with the outer diameter, and a concentricity on the order of submicrons is required between the insertion hole and the outer diameter.

In today's world, where the markets of automobiles and household electrical appliances have reached saturation and where the demand for computers and information equipment has increased, the technical field is expanding where there is a requirement for precision grinding of the cylindrical surface of a cylindrical workpiece of minute size constituting a mechanical part (a rotation shaft in a hard disk apparatus, a recording head rotation shaft in a video camera, a bearing therefor, etc.) for use in such products as are in increasing demand.

Incidentally, a conventional grinding machine has been used for precision grinding of such a cylindrical-surface of minute size, the grinding machine having on a base of great mass and high rigidity heavy and robust tables for moving a workpiece and a grinding wheel, there being provided on these tables a heavy and robust workpiece retaining spindle and a grinding wheel retaining spindle. Usually, the main body of this conventional grinding machines for minute workpieces has a floor area of 1 $m^2$ and a weight of close to 1 ton. In an example, a workpiece having a diameter of 4 mm, a length of 10 mm, and a weight of 1 g is machined by a machine one million times as heavy as that.

On the other hand, in the case of grinding the cylindrical surface of a general mechanical part, for example, a workpiece having a diameter of 4 cm, a length of 10 mm, and a weight of 1 kg, it is machined by a machine tool with a floor area and a weight of not more than 10 $m^2$ and 10 tons, which means the ratio of the weight of the machine to the weight of the workpiece is approximately 10 thousand.

Thus, the grinding machine for machining a workpiece of minute size occupies and exhibits a large floor area and a large weight which are out of proportion to the workpiece. This excessively large grinding machine is based on the idea of "The larger serves for the smaller". That is, the grinding machine for machining a workpiece of minute size is endowed with the ability to machine a relatively large workpiece, and the grinding wheel driving motor is large and heavy and exhibits an accordingly large output. The grinding wheel base on which the large and heavy driving motor is placed is inevitably large and heavy. Further, the table on which the workpiece and the grinding wheel are to be placed is also larged and heavy. Further, the feed screw for moving these heavy tables is thick, and the driving motor for the feed screw is large and heavy.

It is to be assumed that this tendency of the grinding machine for machining a workpiece of minute size to be excessively large and heavy is attributable to the following conventional circumstances:

(1) No machine tool dedicated to minute parts has been commercially produced.

(2) In purchasing a machine tool, it is generally believed that the larger the size and capacity, the better.

However, in machining a minute size workpiece, such as a ferrule, the rotation shaft of a hard disk apparatus, the recording head rotation shaft of a video camera, and the bearings thereof, the volume of the portion removed by machining is small, and the requisite power for machining is also small.

Thus, for the machining of a minute size workpiece, running a large and heavy machine tool by a high power motor, constructing a large building of high load capacity for installing the large and heavy machine tool, and providing a wide air conditioning facilities for accommodating the machine tool, are superfluous and wasteful.

By using a motor of an output, weight, and size suitable for the machining of a minute size workpiece and appropriately reducing the size and weight of the spindle stock, table, etc. it is possible to machine a minute size workpiece without involving an excessively large machine tool, excessive energy consumption, or excessive plant facilities.

After studying this possibility, the present inventor has found out that it is possible to reduce the size and weight of a machine tool so as to realize a machine which is approximately 20 to 30 kg in weight and 20 to 30 cm across in size and which can be raised and moved by hand.

If such a miniaturized machine is realized, it would provide the following advantages from the economical viewpoint. It is possible to reduce the requisite power for the machine tool itself. It is also possible to reduce the price of the machine, the plant facility cost, and the plant running cost, such as the air conditioning cost. Further, when the machine is out of order, instead of depending on the conventional in-field services, which involve a high cost and a long downtime, it is possible to obtain a substitute from the maker by using courier service, thereby recovering the failure in a short time and at low cost.

Specifically speaking, in realizing a reduction in the weight and size of a grinding machine for machining a minute part, the following are to be taken into account: supply and discharge of a minute workpiece, rotary drive, feed, in-process sizing, etc.

In cylindrically grinding a cylindrical workpiece, a chuck-drive/center-support system is widely used, in which the forward end of a workpiece chuck gripped by a main shaft chuck is center-supported. Further, in a known lathe using the chuck-drive/center-support system, the centers are rotated in synchronism with the chuck to eliminate relative rotation between the workpiece and the centers to thereby achieve an improvement in rotation accuracy (See, for example, patent document 1).

Patent Document 1

JP 2000-71104 A (See Paragraphs 0019 and 0020, and FIGS. 1 and 2)

In the chuck-drive/center-support system, however, the chuck has a rather large outer size and requires much space, with the result that the arrangement space for the workpiece supply/discharge device, the rotary drive device, the feed device, the in-process sizing device, etc. is rather small. Further, grinding is performed on an outer configuration basis, and not on a center-hole basis.

Generally speaking, to machine a cylindrical workpiece on a center-hole basis with high concentricity, the optimum method to be adopted is a two-center support type machining system, in which the cylindrical workpiece is held, with the forward ends of a pair of centers being inserted into center holes provided in the end surfaces of the cylindrical workpiece. However, in machining a small diameter cylindrical workpiece, such as a Zr ferrule, it is necessary to arrange a machining tool such as a grinding wheel, a workpiece supply/discharge device, a sizing device, etc. close to each other in a small space around the workpiece, which results in a poor operability if ordinary "carriet turning" is adopted, thereby hindering a reduction in size and weight.

Instead of "carriet turning", patent document 2 discloses a ferrule rotating method using a rubber roller as shown in FIG. 11. In FIG. 11, a ferrule 1 constituting a cylindrical workpiece is elastically supported between a stationary center 101 and a tailstock center 102 axially movable but not rotatable by the resilient force of a pressurizing spring 103, and the cylindrical workpiece 1 is presses by a rotating rubber roller 104 from the direction opposite to a rotating grinding wheel 20 to rotate the cylindrical workpiece 1 by frictional force. In order that a sufficient frictional force may be obtained between the contact surfaces of the cylindrical workpiece 1 and the rubber roller 104, the cylindrical workpiece 1 is held in press contact with the rubber roller 104 with a force strong enough to form a recess in the rubber roller 104.

Patent Document 2

JP 10-113852 A (Japanese Patent No. 3171434) (paragraphs 0017 through 0019, FIG. 2)

In this ferrule rotating method, there is no need to change the clamping position and perform grinding two times as in the case of the "carriet turning", in which the cylindrical surface to be ground is clamped. Thus, the method is superior in operational efficiency and provides an improved concentricity for the cylindrical workpiece 1.

When the workpiece 1 held by the two centers is rotated, the forward ends of the centers 101 and 102 and the center holes of the workpiece 1 slip on each other. Since the cylindrical workpiece 1 is pressurized in opposite directions by the rubber roller 104 and the grinding wheel 20, equilibrium in force can be achieved during grinding in-feed. However, in the condition before and after actual grinding, in which the grinding wheel 20 is not in contact with the cylindrical workpiece 1, and in the finish grinding step, the cylindrical workpiece 1 is pressurized in one radial direction by the rubber roller 104. The period of time in which the cylindrical workpiece 1 is rotated before and after actual grinding and the period of time of the finish grinding step are longer than the period of time for grinding in-feed, and, all the while, the centers 101 and 102 are pressurized in one radial direction by the center holes of the cylindrical workpiece 1. Thus, as a large number of cylindrical workpieces 1 are repeatedly ground, "partial wear" tends to be caused by frictional force. The smaller the diameter of the cylindrical workpiece and the center hole diameter, the more conspicuous becomes this "partial wear". It is to be assumed that this is attributable to a reduction in the contact area between the centers and the center holes.

Furthermore, usually, this "partial wear" of the centers is not uniform between the two centers 101 and 102. In particular, when the hole diameters of the centers on the right and left sides of the cylindrical workpiece 1 are different, the partial wear is always nonuniform. Although not so serious as in the case of "carriet turning", this nonuniformity in "partial wear" on the right and left sides leads to a certain degree of defective cylindricality of the ground cylindrical surface of the cylindrical workpiece 1.

To avoid this defective cylindricality, the cylindricality of the cylindrical workpiece 1 after grinding is monitored, and when the permissible range has been approached, or when a fixed number of workpieces have been ground, the grinding machine is stopped, and fine adjustment is empirically performed on the center positions, or the centers are replaced for positional adjustment.

In a case where a high degree of precision in cylindricality is required, the frequency of center adjustment and replacement increases even with this rotating method, with the result that the availability factor is reduced, and the center consumption increases, which constitutes an obstruction to a reduction in production cost.

Further, nowadays, there is an increasing demand for a high precision machining enabling a cylindrical workpiece with a very small outer diameter of approximately 1.25 mm to be machined with a high degree of cylindricality. However, when the outer diameter of the cylindrical workpiece 1 is diminished, the rotation by the rubber roller 104 becomes difficult.

Further, the presence of the rubber roller does not contribute to a reduction in size; it diminishes the space around the workpiece to some degree, and somewhat reduces the degree of freedom in the arrangement of the sizing device, the supply/discharge device, etc.

SUMMARY OF THE INVENTION

The present invention has bee made in order to solve the above-mentioned problems, and an object thereof is to provide a grinding machine and a centering method for the centers thereof which is suitable for center-hole-referenced high precision grinding of a workpiece with a small diameter, in which the requisite space for the center support rotating mechanism for a workpiece and the in-feed mechanism is reduced to facilitate miniaturization, and in which it is easy to secure the space for the supply and discharge of the workpiece and sizing measurement.

In order to attain the above-mentioned object, a center support grinding method according to the present invention is characterized in that a cylindrical workpiece is supported by two centers, and that the workpiece is ground while being rotated by the two centers.

Further, a center support grinding method of the present invention is characterized by including: a rough grinding step for performing rough grinding on a cylindrical workpiece while rotating the workpiece by the two centers holding the workpiece; and a finish grinding step for performing, after the rough grinding step, finish grinding on the workpiece while rotating one center, with the other center being fixed in position.

In those methods, the following structure may be adopted in which the two centers are rotated in synchronism with each other by separate built-in motors, or the two centers are rotated by separate built-in motors in order that the fixation of one center is effected by a stationary constraining force of the built-in motor.

Further, a center support grinding machine according to the present invention is characterized by including: a main shaft unit; a main spindle rotatably retained in the main shaft unit; a rotary drive center retained by the main spindle and adapted to be engaged with one center hole of a cylindrical workpiece; a main spindle rotary drive means built into the main shaft unit and adapted to rotate the main spindle; a tailstock unit; a tailstock spindle retained in the tailstock unit so as to be slidable in the axial direction; a tailstock center retained by the tailstock spindle, arranged so as to be opposed to the rotary drive center in the same axis, and adapted to be engaged with the other center hole of the cylindrical workpiece to hold the cylindrical workpiece together with the rotary drive sensor; a tailstock center urging means for elastically urging the tailstock center toward the rotary drive center side to hold the cylindrical workpiece between the rotary drive center and the tailstock center; and an in-feed means on which the rotary drive center, the main spindle rotary drive means, and the tailstock center are mounted and which moves the rotary drive center, the main spindle rotary drive means, and the tailstock center by a swiveling motion to thereby cause the cylindrical workpiece held between the centers and rotated to make an in-feed operation with respect to a grinding wheel.

Further, in the above-mentioned center support grinding machine, the tailstock spindle is rotatably retained by the tailstock unit, and there is further provided a tailstock spindle rotary drive means built into the tailstock unit and adapted to rotate the tailstock spindle in the same direction as the main spindle. Furthermore, the main spindle rotary drive means and the tailstock spindle rotary drive means are rotated in synchronism with each other. Otherwise, at least one of the main spindle rotary drive means and the tailstock spindle rotary drive means has a stationary constraining force.

Further, the tailstock spindle rotary drive means is an inner rotor type electric motor, an inner rotor of the motor being attached to the tailstock spindle, and an outer stator thereof being fixed to the tailstock unit so that the inner rotor of the motor moves in the axial direction with respect to the stator when the tailstock spindle moves in the axial direction.

Further, in the above-mentioned center support grinding machine, the following may be adopted in which the tailstock center urging means also serves as a tailstock spindle axial movement means for moving the tailstock spindle in the axial direction, or the tailstock center urging means is provided in the tailstock unit, and the tailstock unit is movable in the axial direction of the tailstock spindle, moving in the axial direction of the tailstock spindle by the spindle axial movement means.

Further, the following may be adopted in which the in-feed means retains the rotary drive center, the main spindle rotary drive means, and the tailstock center by an eccentric bearing eccentrically arranged with respect to the rotary drive center and the tailstock center, and is adapted to make an in-feed operation through swiveling of the eccentric bearing, or that that the in-feed means has an in-feed lever on which the rotary drive center, the main spindle rotary drive means, and the tailstock center are mounted, the in-feed operation being made through swiveling of the in-feed lever.

A centering method for centers of a rotary drive center device according to the present invention is a method in which the centers are respectively mounted to opposing center mounting holes of a pair of spindles arranged in the same axis and in which a cylindrical workpiece is rotated while being held between the centers, characterized in that the centers are respectively mounted to the spindles and that the centers are ground for centering by a grinding tool while rotating the spindles.

In the above-mentioned method of the present invention, the following may be adopted in which a single grinding tool is equipped with grinding surfaces for grinding a pair of opposing centers, the centers being ground simultaneously for centering by the grinding tool.

BRIEF DESCRIPTION OF THE SEVERAL VIEWS OF THE DRAWINGS

A preferred form of the present invention is illustrated in the accompanying drawings in which:

FIG. 10 are conceptual drawings showing an embodiment of the center centering method of this invention, of which portion

DETAILED DESCRIPTION OF THE PREFERRED EMBODIMENTS

Embodiments of this invention will now be described with reference to FIGS. 1 through 10.

Figure 1:
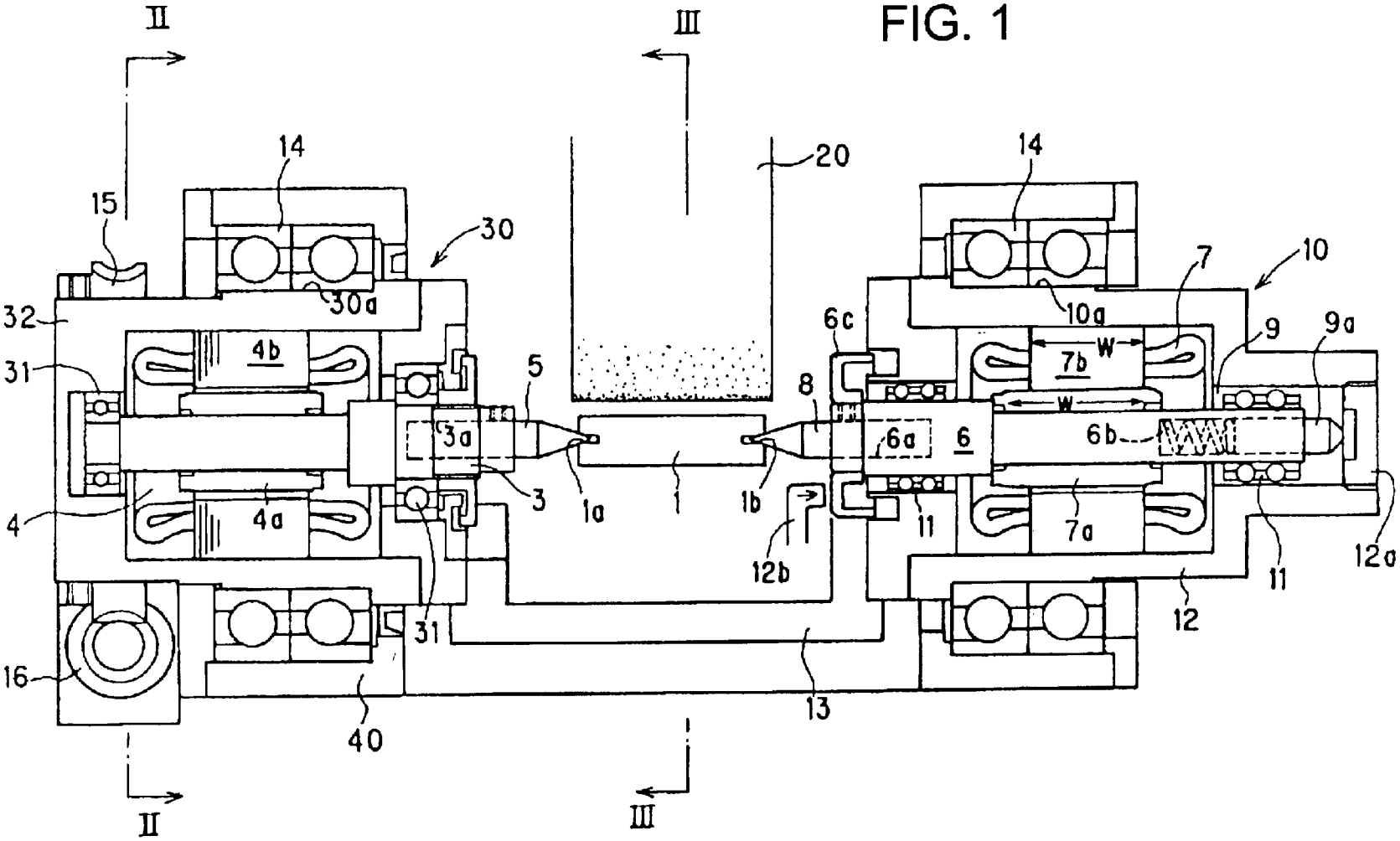
FIG. 1 is a longitudinal sectional view showing an embodiment of the grinding machine of this invention.
Figure 2:
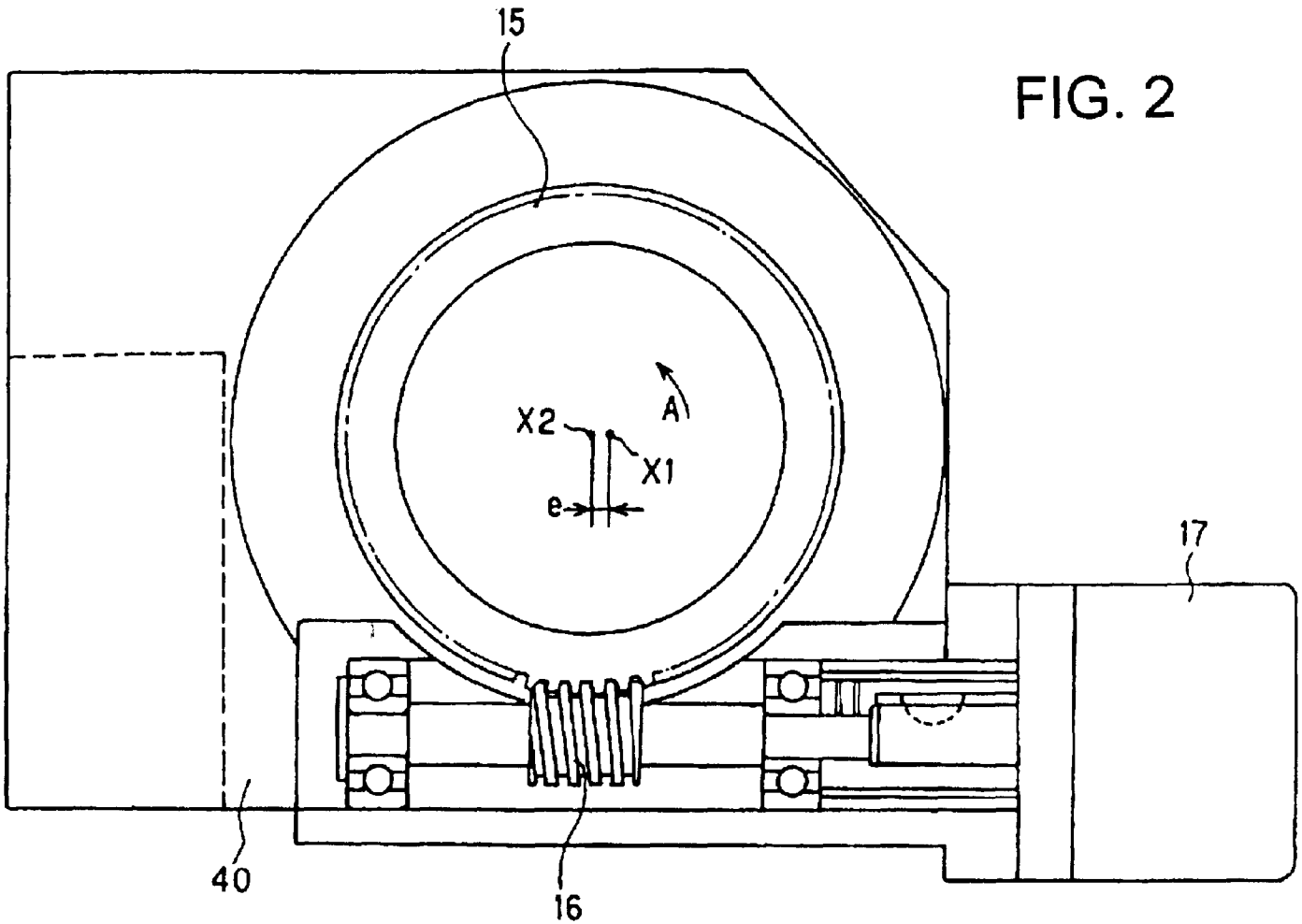
FIG. 2 is a sectional view taken along the line II—II of FIG. 1.
Figure 3:
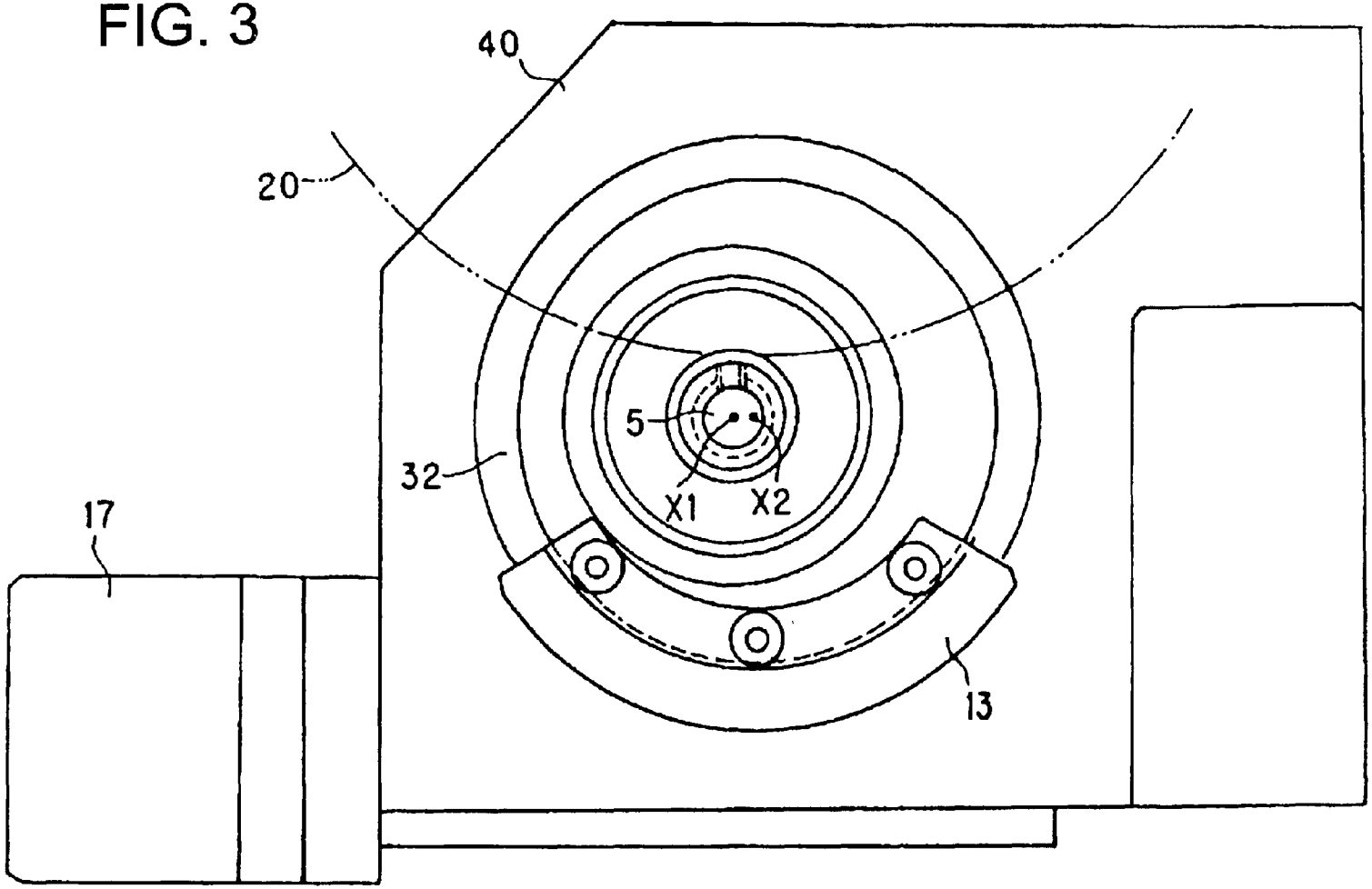
FIG. 3 is a sectional view taken along the line III—III of FIG. 1.

FIGS. 1 through 3 show a first embodiment of the center support grinding machine of this invention.

In FIG. 1, numeral 1 indicates a cylindrical workpiece such as a ferrule equipped with center holes 1*a* and 1*b* in the end surfaces thereof and having an outer diameter of, for example, 1.25 mm, and numeral 20 indicates a grinding wheel adapted to grind the outer peripheral surface of the cylindrical workpiece and to perform grinding for centering on the centers.

Numeral 3 indicates a main spindle rotatably supported on the front and back sides by a main shaft unit frame 32 by means of bearings 31. Secured to this main spindle 3 is an inner rotor 4*a* of a built-in type induction motor (main spindle rotary drive means) 4, and the main spindle 3 is rotated by the induction motor 4. Further, a center mounting hole 3*a* is provided in the forward end portion of the main spindle 3, and a rotary drive center 5 is inserted into the center mounting hole 3*a* for mounting. The conical surface at the forward end of the rotary drive sensor 5 is engaged with one center hole 1*a* of the cylindrical workpiece 1.

An outer stator 4*b* of the induction motor 4 is secured in position inside the main shaft unit frame 32.

The main shaft unit frame 32 forms, together with the main spindle 3 and the main spindle rotary drive means 4 incorporated into the main shaft unit frame 32, a main shaft unit 30.

Numeral 6 indicates a tailstock spindle supported by a tailstock unit frame 12 by means of ball bearings 11 so as to be rotatable and axially slidable. Secured to this tailstock spindle 6 is an inner rotor 7*a* of a built-in type induction motor (tailstock spindle rotary drive means) 7, and the tailstock spindle 6 is rotated by the induction motor 7 in the same direction and at the same speed as the main spindle 3. Further, a center mounting hole 6*a* is provided in the forward end portion of the tailstock spindle 6, and a tailstock center 8 is inserted into the center mounting hole 6*a* for mounting. The conical surface at the forward end of the tailstock center 8 is engaged with the other center hole 1*b* of the cylindrical workpiece 1.

An outer stator 7*b* of the induction motor 7 is secured in position inside the tailstock unit frame 12.

The tailstock unit frame 12 and the tailstock spindle 6 incorporated into the tailstock unit frame 12 form a tailstock unit 10.

The main spindle 3, the two induction motors 4 and 7, the rotary drive center 5, the tailstock spindle 6, and the tailstock center 8 are arranged in the same axis.

A slide rod 9*a* is inserted into a hole 6*b* on the rear end side of the tailstock spindle 6, and a tailstock center urging spring (tailstock center urging means) 9 is provided under elastic force between the slide rod 9*a* and the bottom portion of the hole 6*b* on the rear end side of the tailstock spindle 6, abutting the forward end of the slide rod 9*a* against a cap screw 12*a* mounted to the tailstock unit frame 12. The tailstock spindle 6 is urged toward the rotary drive center 5 opposed thereto by the tailstock center urging means 9, and the rotary drive center 5 and the tailstock center 8 are engaged and held in contact with the center holes 1*a* and 1*b* of the cylindrical workpiece 1 to thereby hold the cylindrical workpiece 1 therebetween.

With the cylindrical workpiece 1 being held by the sufficient urging force of the tailstock center urging means 9, the torque of the induction motors 4 and 7 causes the cylindrical workpiece 1 to rotate by utilizing the frictional force caused due to the pressurization of the centers 5 and 8 and the center holes 1*a* and 1*b*.

In order to return the tailstock center 8 to release the cylindrical workpiece, a tailstock center returning lever 12*b* is moved to the right as seen in FIG. 1 by a returning lever driving device (not shown) and a butted against a tailstock spindle dust-proof cover 6*c*, and the tailstock center is returned while compressing the center urging spring 9 by pressing the tailstock spindle 6 to the right. That is, in this embodiment, the tailstock center returning lever 12*b*, the returning lever driving device, and the tailstock center urging spring 9 form tailstock spindle axial movement means, whereby it is possible to apply the machine to cylindrical workpieces of different lengths. The tailstock center urging means 9 also serves as the tailstock spindle axial movement means for axially moving the tailstock spindle 6.

With the axial movement of the tailstock spindle 6, the inner rotor 7*a* of the motor 7 also moves axially relative to the outer stator 7*b*. In this embodiment, a stator width W and a rotor width w are set such that the motor 7 can provide sufficient torque no matter what axial position the tailstock spindle 6 may be situated. In the example shown, the setting is made as follows: w>W+tailstock spindle stroke.

The main shaft unit 30 and the tailstock unit 10, axially aligned with each other, are integrally fixed together by a connection frame 13. This connection frame 13 has an arcuate section in order that it may be spaced apart as much as possible from an axis x1 of the units 10 and 30 and that a desired level of rigidity may be obtained. By arranging the connection frame 13 so as to be sufficiently spaced apart from the axis x1, it is possible to secure the space for supply and discharge, sizing, etc. around the workpiece.

Further, the respective outer peripheral cylindrical surfaces 30*a* and 10*a* of the main shaft unit 30 and the tailstock unit 10 has an axis x2 decentered by e at a phase angle position common to the axis x1 of the units 10 and 30 (See FIG. 2). And, the two outer peripheral cylindrical surfaces 30*a* and 10*a* are rotatably held by a base 40 by means of unit support bearings (eccentric bearings) 14.

A worm wheel 15 is fixed to the outer periphery of the main shaft unit frame 32 so as to be concentric with the unit support bearings 14, and this worm wheel 15 is in mesh with a worm 16 rotatably provided on the base 40. And, this worm 16 is rotated by a servo motor 17. These driving systems 15, 16, and 17 are also sufficiently spaced apart from the workpiece 1 and arranged on the main shaft unit 30 side or on the tailstock unit 10 side to secure the space for supply and discharge, sizing, etc. around the workpiece.

When the worm 16 is rotated by the servo motor 17, the worm wheel 15 rotates at a minimum speed in the direction of the arrow A in FIG. 2, and the axis x1 of the main shaft unit 30 and the tailstock unit 10 swivels by a minute angle around the axis x2 of the outer peripheral cylindrical surfaces 30*a* and 10*a* of the main shaft unit 30 and the tailstock unit 10. This swiveling causes the workpiece 1 held in the axis x1 to move toward and away from the grinding wheel 20 as shown in FIG. 3, that is, to perform in-feed operation.

In other words, the in-feed means of this embodiment retains the rotary drive center 5, the main spindle rotary drive means 4, and the tailstock center 8 by means of the eccentric bearings 14 decentered by e with respect to the rotary drive center 5 and the tailstock center 8, and performs in-feed operation through swiveling of the eccentric bearings 14.

The grinding operation in the embodiment shown in FIGS. 1 through 3 is conducted as follows.

When the tailstock center returning lever 12*b* retracts the tailstock spindle 6, and the workpiece 1 is fed between the two centers 5 and 8 by an automatic feeding device (not shown), the tailstock center returning lever 12*b* is returned and the tailstock spindle 6 advances by the resilient force of the spring 9 to hold the workpiece 1 between the two centers 5 and 8.

Next, the motors 4 and 7 operate to rotate the two spindles 3 and 6 in the same direction and at the same speed. The torque thereof is transmitted to the workpiece 1 elastically held between the centers 5 and 8 by the frictional force between the centers and center holes, and the workpiece 1 rotates with the centers 5 and 8 and the spindles 3 and 6.

Here, the servo motor 17 operates, and the main shaft unit 30, the connection frame 13, the tailstock unit 10, and the workpiece 1 are swiveled around the axis x2 to move the workpiece 1 toward the grinding wheel 20 so as to cause the workpiece 1 to be cut by the grinding wheel 20, thereby performing plunge grinding.

Figure 4:
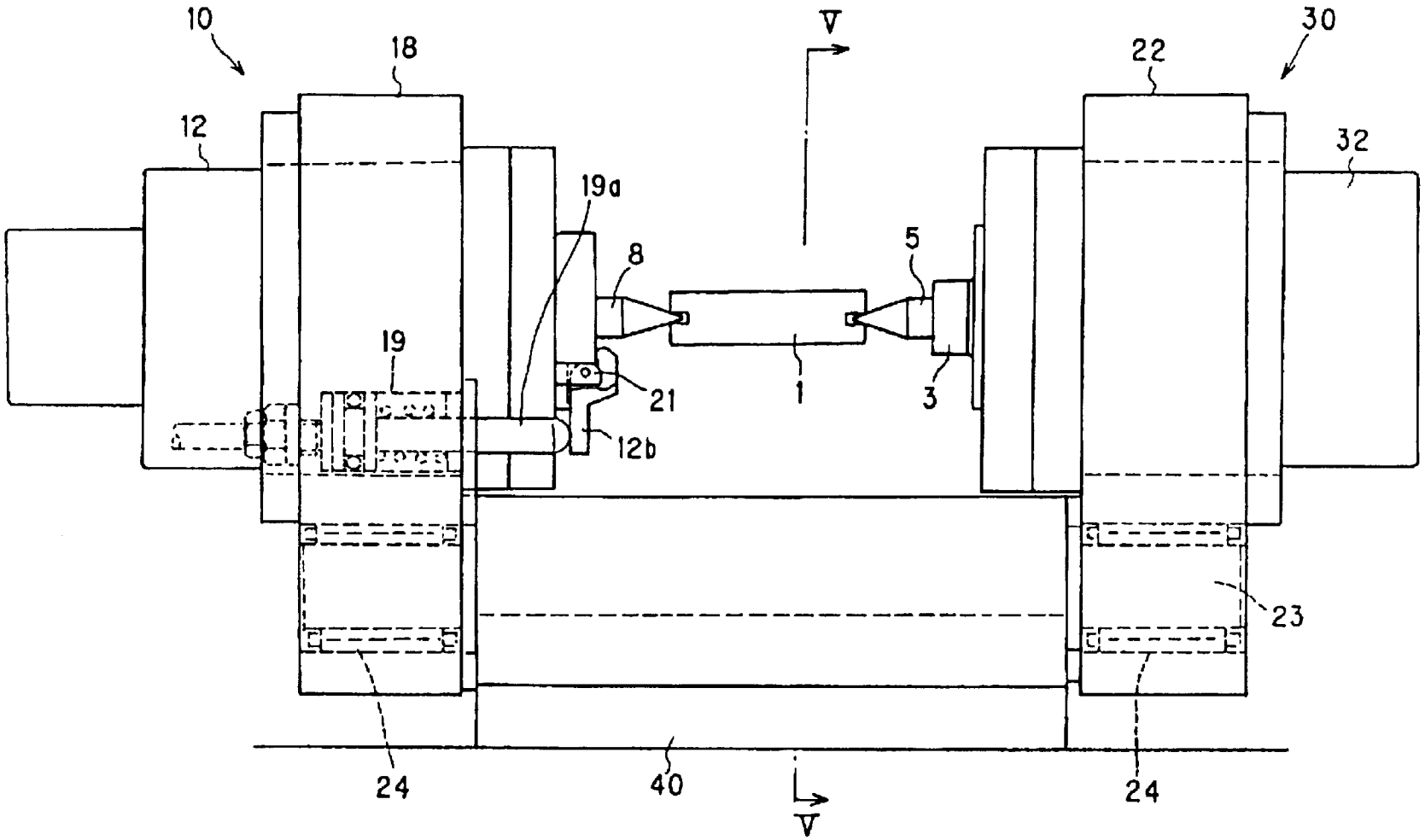
FIG. 4 is a longitudinal sectional view showing another embodiment of the grinding machine of this invention.
Figure 5:
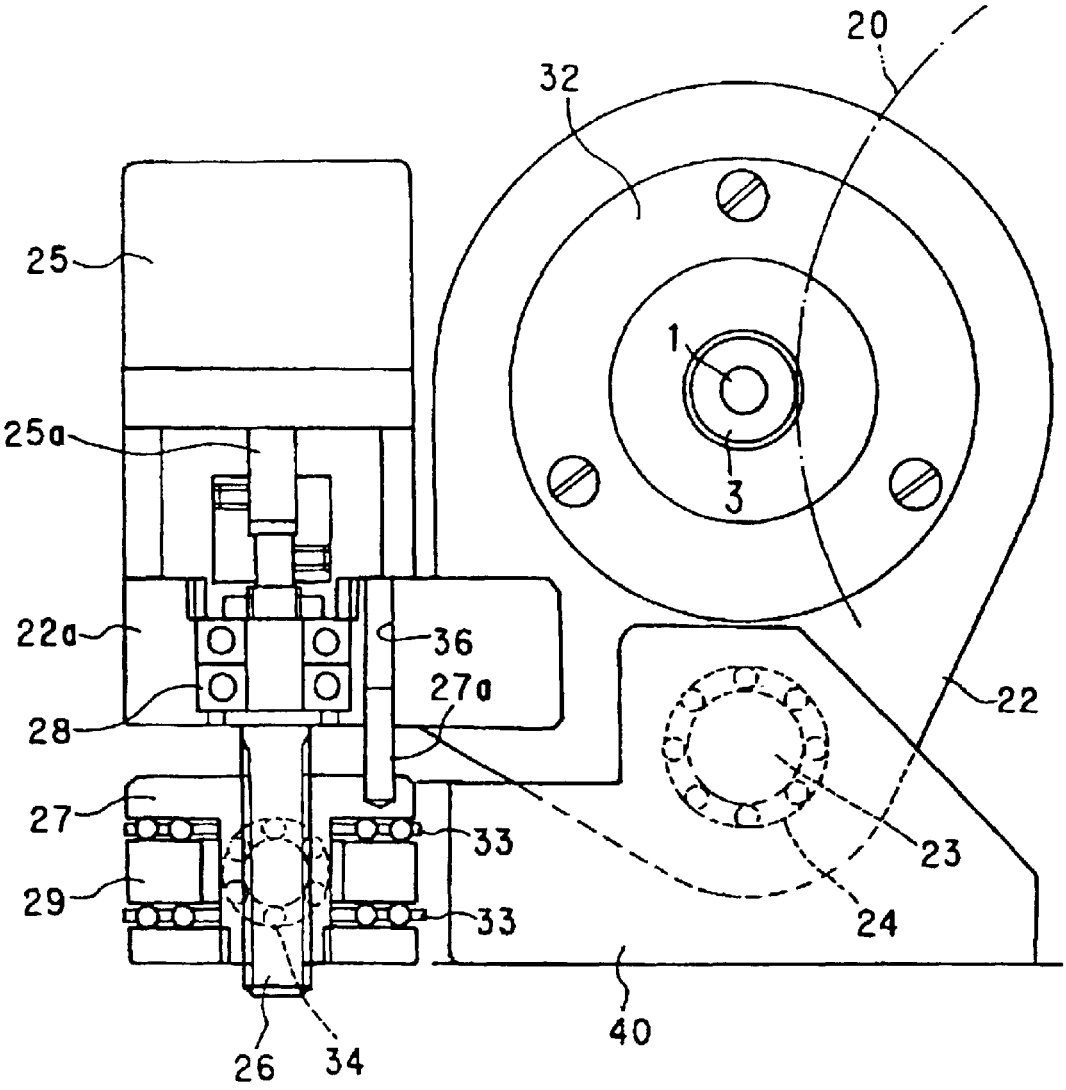
FIG. 5 is a sectional view taken along the line V—V of FIG. 4.

FIGS. 4 and 5 show a second embodiment of the center support grinding machine of this invention.

In FIGS. 4 and 5, the components which are the same as those shown in FIGS. 1 through 3 are indicated by the same reference numerals, and a detailed description thereof will be omitted. Further, the main shaft unit 30, the main spindle driving means therein, the main spindle, the tailstock unit 10, the tailstock spindle driving means therein, the tailstock center urging means, and the connection frame are the same as those of FIG. 1, so that they are not shown in detail.

FIG. 4 shows in detail the tailstock spindle axial movement means. The tailstock spindle axial movement means is equipped with an air cylinder 19, a piston rod 19*a* sliding in the air cylinder 19, and the tailstock center returning lever 12*b*.

The air cylinder 19 is provided on an in-feed lever 18 described below. Although not clearly shown, the tailstock center returning lever 12*b* has its fulcrum 21 supported by the in-feed lever 18. Further, one end of the tailstock center returning lever 12*b* can be engaged with the forward end of the piston rod 19*a*, and the other end thereof is engaged with the tailstock spindle 6 as in the case of FIG. 1.

When the tailstock center 8 is to be retracted from the main shaft center 5 side, the air cylinder 19 is operated to cause the piston rod 19*a* to advance to the right as seen in the drawing and abut the tailstock center returning lever 12*b* to swivel the same, thereby retracting the tailstock spindle 6.

Next, the in-feed means of this embodiment will be described.

The outer peripheral cylindrical surfaces of unit frames 32 and 12 of the main shaft unit 30 and the tailstock unit 10 are respectively fixed to the in-feed levers 18 and 22. Unlike those in FIG. 1, the outer peripheral cylindrical surfaces of the unit frames 32 and 12 are not decentered. And, the in-feed levers 18 and 22 are rotatably retained by the end portions of a lever shaft 23, which is mounted and fixed horizontally to the base 40, through the intermediation of needle bearings 24.

As shown in FIG. 5, the in-feed lever 22 has a projecting portion 22*a* situated at a position somewhat spaced apart from the lever shaft (the fulcrum of the in-feed lever) 23, and torque for in-feed operation is applied to this projecting portion 22*a*.

Further, the in-feed means of this embodiment has a servo motor 25 provided on the projecting portion 22*a*, an in-feed screw 26 connected to an output shaft 25*a* of the servo motor 25, and a nut 27 to be threadedly engaged with the in-feed screw 26.

The in-feed screw 26 is rotatably retained by the projecting portion 22*a* of the in-feed lever 22 through the intermediation of a bearing 28, and the outer peripheral portion of the nut 27 holds an oscillation plate 29 through the intermediation of thrust bearings 33. The thrust bearings 33 have a construction in which a plurality of balls rotatably retained by retainers are held between the flat end surfaces of the nut 27 and the oscillation plate 29, whereby the nut 27 can freely slide in both the radial and rotating directions relative to the oscillation plate 29. Further, the nut 27 has on its upper surface an erect pin 27*a*, and this pin 27*a* is slidably inserted into a guide hole 36 of the projecting portion 22*a*, thereby preventing drag due to the rotation of the in-feed screw 26.

Although not clearly shown in the drawing, the oscillation plate 29 is retained by the base 40 through the intermediation of a bearing 34 arranged parallel to the center axis, and can oscillate using the bearing 34 as the oscillation shaft. Thus, when the servo motor 25 rotates the in-feed screw 26, the in-feed screw 26 moves vertically, guided by the nut 27. Besides, the in-feed screw 26 swivels around the lever shaft 23 together with the in-feed lever 22.

The swiveling of the in-feed lever 22 causes the rotary drive center 5, the main spindle rotary drive means 4, the tailstock center 8, etc. mounted on the in-feed lever 22 to move, whereby the cylindrical workpiece 1, which is held between the centers 5 and 8 and rotated, is made to conduct in-feed operation with respect to the grinding wheel 20.

Figure 6:
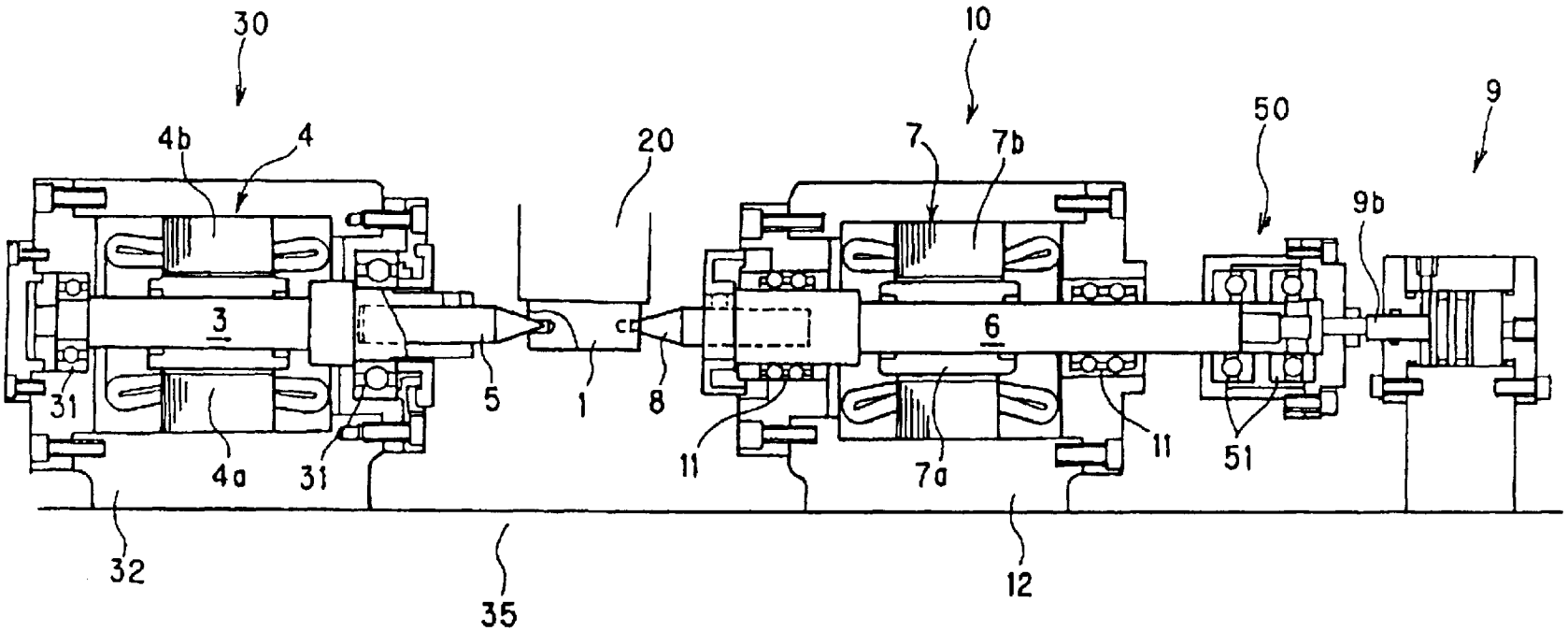
FIG. 6 is a longitudinal sectional view, with parts omitted, showing another embodiment of the grinding machine of this invention.

FIG. 6 shows a third embodiment of the center support grinding machine of this invention.

In FIG. 6, the components which are the same as those of FIGS. 1 through 5 are indicated by the same reference numerals, and a detailed description thereof will be omitted.

In FIG. 6, the main shaft unit 30 and the tailstock unit 10 are, as in FIG. 4, arranged in the same axis and fixed to an in-feed lever 35. On the in-feed lever 35 and at the rear of the tailstock unit 10, there is further provided the tailstock center urging means 9 using an air cylinder device, and an actuator (pison rod) 9*b* thereof is connected to the rear end portion of the tailstock spindle 6 through the intermediation of a coupling 50. The coupling 50 contains thrust ball bearings 51 therein, therein and connects the tailstock spindle 6 and the actuator 9*b*, with the thrust ball bearings 51 therebetween, transmitting the axial movement of the actuator 9*b* to the tailstock spindle 6. Since the thrust ball bearings 51 rotate, the rotation of the tailstock spindle 6 is not transmitted to the actuator 9*b*.

Although not shown, the in-feed lever 35 is equipped with the lever driving mechanism as shown in FIG. 5 to perform in-feed operation.

When the tailstock center urging means 9 operates and the actuator 9*b* thereof moves the tailstock spindle 6 in the axial direction, the rotor 7*a* moves together with the tailstock spindle 6, moving in the axial direction relative to the stator 7*b*. When the workpiece 1 held between the centers 5 and 8 is to be rotated, it is necessary to energize the motor 7, whereas, when the workpiece 1 is attached, detached, or the like, there is no need to energize the motor. In view of this, this embodiment adopts an arrangement in which the rotor 7*a* and the stator 7*b* are opposed to each other just at the position where the workpiece is held. Further, when one of the rotor 7*a* and the stator 7*b* is longer than the other, the tailstock spindle 6 can be rotated even at a longitudinally shifted position, thus making it possible to machine cylindrical workpieces of different lengths.

In the embodiment of FIG. 6 also, plunge grinding is performed on the cylindrical surface by in-feeding the grinding wheel 20 while holding the cylindrical workpiece 1 between the rotary drive center 5 and the tailstock center 8 by the urging force of the tailstock center urging means 9. The main spindle driving means (motor) 4 rotates the rotary drive center 5. The tailstock spindle driving means (motor) 7 rotates the tailstock center 8. The cylindrical workpiece 1 is rotated by the two rotating centers 5 and 8, and the cylindrical workpiece 1 is rotated by the frictional force between the centers and the center holes of the cylindrical workpiece 1. The in-feed lever 35 swivels relative to the rotating cylindrical workpiece 1, whereby in-feed for plunge grinding is effected. In this embodiment also, the tailstock center urging means 9 performs in-feed swiveling motion together with the tailstock unit 10.

Incidentally, it is not absolutely necessary for the tailstock center urging means to perform swiveling motion as long as the tailstock spindle can be urged. If the tailstock center urging means does not swivel, the burden on the swiveling mechanism will be so much the less.

Figure 7:
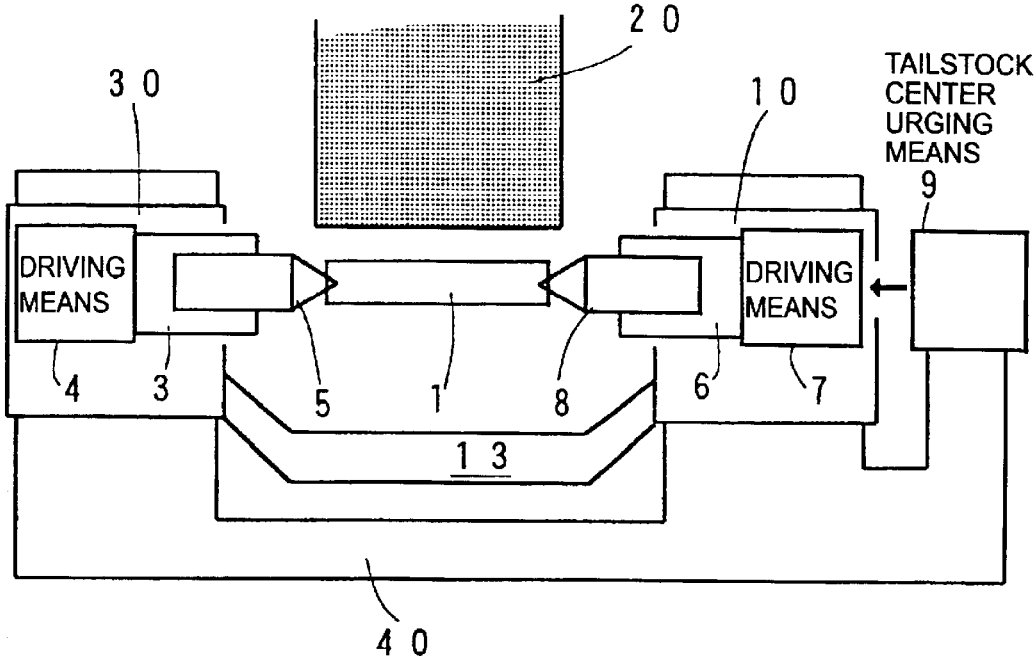
FIG. 7 is an explanatory diagram, with parts omitted, showing another embodiment of the grinding machine of this invention.

FIG. 7 is an explanatory diagram showing a fourth embodiment of this invention, in which the tailstock center urging means 9 is arranged at the rear of the tailstock unit 10, and is prevented from swiveling.

Like the embodiment shown in FIGS. 1 through 3, the embodiment of FIG. 7 adopts an in-unit eccentric arrangement and a swiveling in-feed construction. The components, which are the same as those of FIGS. 1 through 3, are indicated by the same reference numerals, and a detailed description thereof will be omitted.

The tailstock center urging means 9 is provided on the base 40, and the actuator thereof pressurizes the rear end of the tailstock spindle. The in-feed due to the swiveling motion is approximately several mm, so that, from the viewpoint of design, it is easy to prevent detachment of the actuator and the rear end of the tailstock spindle.

Apart from the above-mentioned embodiment, various modifications of the tailstock urging means are possible. For example, it is possible to adopt an arrangement in which the actuator of the tailstock center urging means 9 pressurizes the entire sleeve retaining the rotating tailstock spindle 6 by a bearing, or an arrangement in which it pressurizes the entire tailstock unit. In these cases, there is no need to provide a structure for axial relative sliding of the tailstock spindle 6 and the tailstock unit frame 12. Instead, there is added a structure for axial relative sliding of the tailstock unit frame 12 and the in-feed lever 18.

Figure 8:
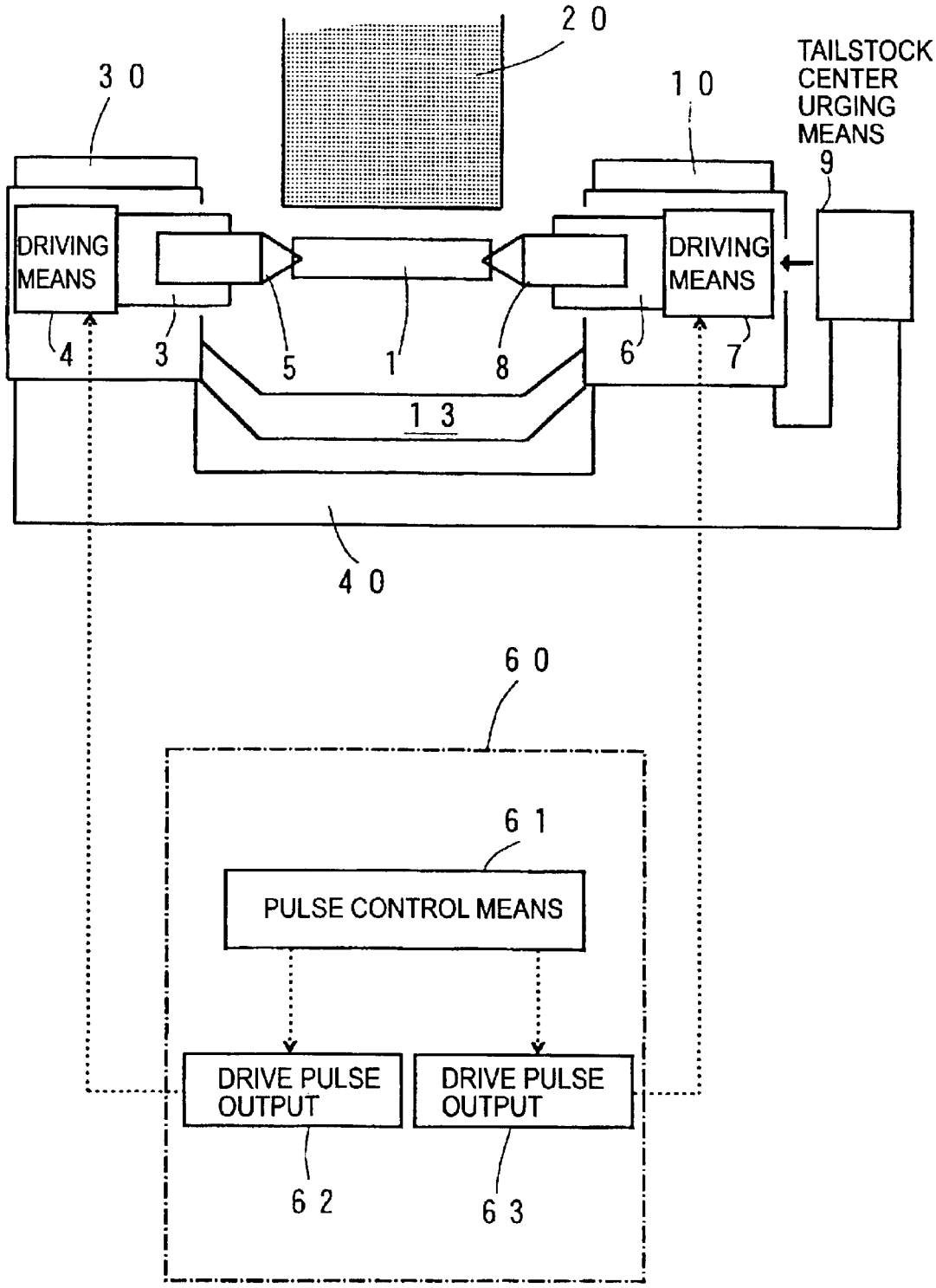
FIG. 8 is an explanatory diagram, with parts omitted, showing another embodiment of the grinding machine of this invention.
Figure 9:
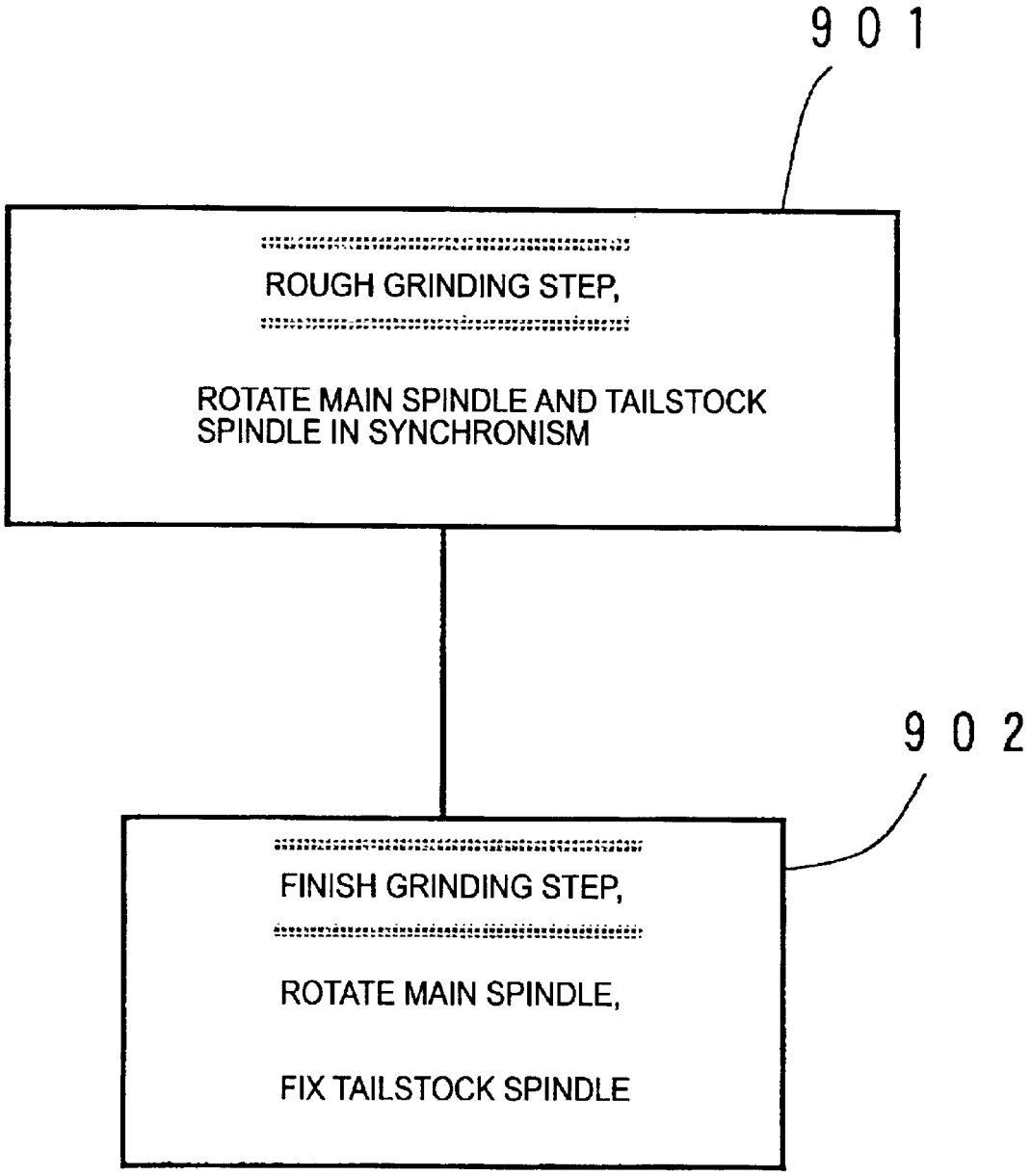
FIG. 9 is a process drawing showing the center support grinding method of this invention.

Next, a fifth embodiment of this invention will be described with reference to FIGS. 8 and 9. In FIG. 8, the main shaft spindle and the tailstock spindle of the embodiment of FIG. 7 are rotated in synchronism with each other. FIG. 9 is a process diagram showing an example of the center support grinding method of this invention.

In FIG. 8, the components which are the same as those of FIG. 7 are indicated by the same reference numerals, and a description thereof will be omitted.

In the embodiment of FIG. 8, a spindle rotation controlling means 60 controls the rotation of the main spindle rotary drive means 4 and the tailstock spindle rotary drive means 7. The spindle rotation controlling means 60 is equipped with a pulse controlling means 61, and drive pulse output means 62 and 63.

The spindle rotary drive means 4 and 7 consist of pulse motors. The pulse motor 4 for the main spindle rotates accurately according to a pulse supplied from the drive pulse output means 62. The pulse motor 7 for the tailstock spindle rotates accurately according to a pulse supplied from the other drive pulse output means 63.

The drive pulse outputs from the drive pulse output means 62 and 63 are controlled independently by control signals from the pulse controlling means 61.

To rotate the main spindle 3 and the tailstock spindle 6 in the same direction in synchronism with each other, the same control signals are supplied from the pulse controlling means 61 to the drive pulse output means 62 and 63 with the same timing. Through this control, the main spindle 3 and the tailstock spindle 6 make a synchronous rotation, and the workpiece 1 held between the centers also makes a synchronous rotation without involving any slippage. Even when the workpiece 1 is ground during steady rotation and receives grinding resistance, no slippage occurs between it and the centers 5 and 8, thus preventing partial wear of the centers 5 and 8. Thus, there is no deterioration in the accuracy of the rotating movement due to partial wear of the centers, thereby maintaining the machining precision, such as circularity and coaxiality, in a satisfactory manner.

To rotate one of the main spindle 3 and the tailstock spindle 6 while maintaining the other stationary, a drive pulse output signal is supplied from the pulse controlling means 61 to one of the drive pulse output means 62 and 63 corresponding to the spindle to be rotated while no drive pulse output signal is supplied to the other drive pulse output means. Through this control, the pulse motor which receives no drive pulse is constrained by the magnetic force between the rotor and stator, and does not rotate due to the so-called stationary constraining force, and only the pulse motor supplied with a drive pulse rotates.

In this case, when the surface conditions of the contact surfaces of the centers and center holes are the same, the larger the effective diameter of the center and center hole, the larger the frictional torque, and the workpiece 1 supported by the two centers is dragged or remains at rest as the spindle on the side where the effective diameter of the center and the center hole is larger rotates. Thus, to cause the workpiece 1 to be dragged by the rotating spindle, the center hole on the side of the rotating spindle is made somewhat larger. Or, when there is no difference between the center holes, the frictional torque between the center hole and the center is reduced by, for example, wetting the center hole on the stationary side with grinding solution before supporting the workpiece 1.

Thus, when one spindle and the workpiece 1 rotate while the other spindle remains at rest, slippage occurs between the spindle at rest and the center hole of the workpiece 1 in contact therewith. When the grinding resistance is relatively low, and the gripping force (pressurizing force) between the center and the workpiece 1 can be made small, the partial wear of the center hole due to the slippage is insignificant. When the spindle remains at rest, the spindle rotation accuracy error is eliminated accordingly, thereby improving the machining accuracy.

In this embodiment, the spindle is fixed by utilizing the stationary constraining force of the stationary side pulse motor, so that, unlike the arrangement in which clamping is effected by some other lock device or the like, no spindle misalignment occurs, and the axis of the center is not deviated, thereby improving the machining precision, and in particular, the coaxiality of the center hole and the machined surface.

While in the embodiment shown in FIG. 8 an example in which a pulse motor is used as the spindle rotary drive means to effect open-loop synchronous rotation control has been described, it is also possible to perform closed-loop control.

Thus, when the grinding of a workpiece requires rough grinding and finish grinding, it is possible to adopt the grinding method as illustrated in FIG. 9.

In FIG. 9, in a rough grinding step 901, the cylindrical workpiece 1 is supported by the centers 5 and 8, and the centers 5 and 8 are rotated in synchronism with each other at the same RPM and in the same direction by the built-in motor to perform rough grinding on the workpiece 1 while rotating the workpiece 1 without involving any slippage. Even if a load from the grinding wheel is applied to the workpiece 1 during rough grinding, slippage does not easily occur between the centers 5 and 8 since the centers 5 and 8 and the workpiece 1 are rotating integrally. Thus, partial wear does not easily occur.

Next, after the rough grinding step 901, finish grinding is performed on the workpiece 1 in a finish grinding step 902, in which one center, in this embodiment the tailstock center 8 on the tailstock spindle 6 side, is rotated, while the other center, i.e., the rotary drive center 5 of the main spindle 3 is fixed by the stationary constraining force of the pulse motor 4. During the finish grinding step, the grinding resistance is low, so that the load applied to the workpiece 1 from the grinding wheel is small, and even if slippage occurs between the fixed main shaft center 5 and the workpiece 1, practically no partial wear occurs on the main shaft center. Since the main shaft 5 is fixed, it is possible to achieve a satisfactory rotary movement precision for the workpiece 1, thereby improving the machining precision.

Next, a centering method for the centers of the center support grinding machine of this invention will be described with reference to FIG. 10.

The centers of a center support grinding machine must be accurately aligned with the axis of the grinding machine holding the workpiece. Otherwise, it is impossible to perform center-hole-referenced precision grinding. In the condition in which the centers are attached to the center holes of the spindles, the axes of the centers are not accurately aligned with the axis of the grinding machine. In view of this, centering is to be performed. For this purpose, in the example shown in FIG. 10, the grinding wheel 2 is equipped with a cylindrical grinding surface 2*a* for performing plunge grinding on the cylindrical workpiece 1 and conical grinding surfaces 2*b* on both sides thereof.

Figure 10A:
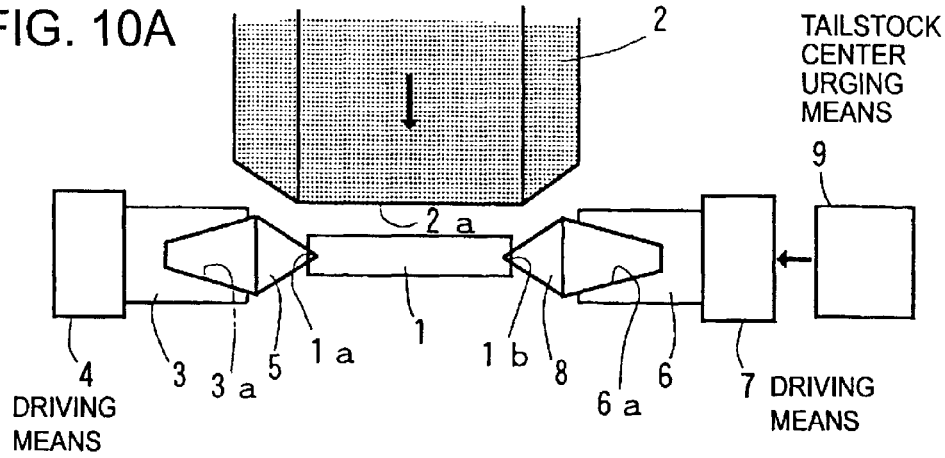
FIG. 10A is an explanatory view illustrating how machining is performed on a workpiece, and portion

In the condition in which centering has been performed on the centers 5 and 8, the arrangement of FIG. 10A is selected, and plunge grinding is performed on the cylindrical workpiece 1 by using the cylindrical grinding surface 2*a*. In the condition in which centering has not been performed due to center replacement or the like, the arrangement of FIG. 10B is selected, and centering is performed on the two centers 5 and 8 by using the conical grinding surfaces 2*b*.

When performing plunge grinding on the cylindrical workpiece 1 supported by the two centers 5 and 8 which have undergone centering, the cylindrical workpiece 1 is held between the two centers 5 and 8 by the urging force of the tailstock center urging means 9. And, in this condition, the torque of the induction motors 4 and 7 is transmitted to the cylindrical workpiece 1 through the centers 5 and 8 to thereby rotate the cylindrical workpiece 1. The rotating grinding wheel 2 is conducted of in-feed operation in the radial direction to the rotating cylindrical workpiece 1, and the cylindrical grinding surface 2*a* is abutted against the cylindrical surface of the cylindrical workpiece 1 to perform plunge grinding. At this time, the conical grinding surfaces 2*b* do not come into contact with the centers 5 and 8.

Figure 10B:
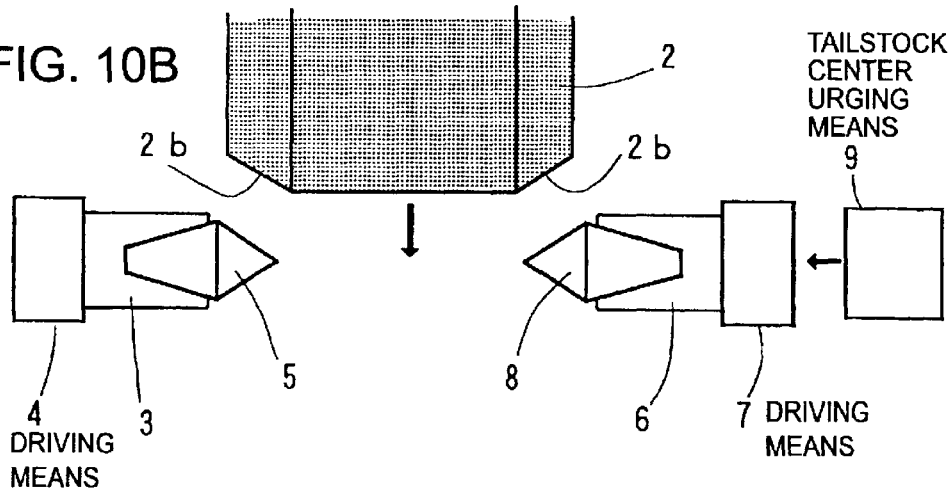
FIG. 10B is an explanatory view illustrating how centering is performed on centers.
Figure 11:
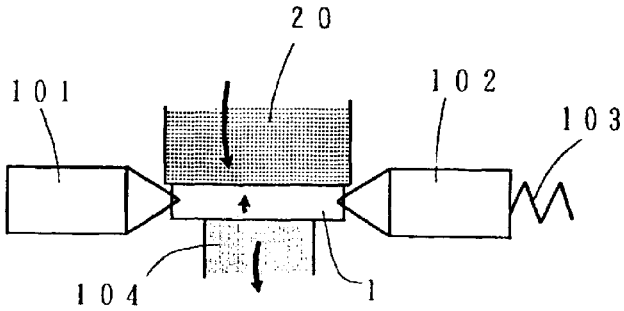
FIG. 11 PRIOR ART
FIG. 11 is an explanatory view showing how a workpiece is retained in a conventional grinding machine, and an example of the driving device.

When centering has not been performed on the centers 5 and 8 yet, the tailstock spindle 6 is slightly retracted to be shifted to the centering position as shown in FIG. 10B, and relative in-feed is effected between the grinding wheel 2 and the centers 5 and 8 while rotating the spindles 3 and 6 and the grinding wheel 2 to abut the conical grinding surfaces 2*b* on both sides of the grinding wheel 2 against the centers 5 and 8 to thereby perform grinding simultaneously thereon. Thus, centering is effected on the centers 5 and 8, with their forward ends being aligned with the axes of the spindles 3 and 6.

While in the embodiment of FIG. 10 centering is simultaneously effected on the centers 5 and 8 by using the grinding wheel 2, the centering method of this invention is not restricted to this. For example, the method of this invention can also be executed by the following centering methods:

1) Grinding on the Machine with the Grinding Wheel Replaced

While keeping the main shaft unit 30 and the centering unit 10 on the base, that is, in the setting for grinding operation, the grinding wheel 20 is detached from the grinding wheel base (not shown), and a center centering grinding wheel (not shown) is set instead. Then, the center 5 or 8 mounted to the spindle 3 or 6 is ground while being rotated to thereby effect centering.

Since the relationship in height and the parallelism between the grinding wheel base, the main shaft unit 30, and the centering unit 10 on the base are the same, this arrangement also allows centering of the centers so as to accurately align them with the axis. It is possible to use separate grinding wheels as the center centering grinding wheels for the rotary drive center 5 and for the tailstock center 8 and change them in performing centering. Alternatively, it is possible to provide two centering grinding surfaces on a single grinding wheel and perform centering successively on the two centers.

2) Grinding with the Main Shaft Unit and the Centering Unit Moved to Another Device There is prepared another centering device that helps to maintain the relative positional relationship between the grinding base, the main shaft unit 30, and the centering unit 10. And, the main shaft unit 30 and the centering unit 10 are detached from the base, and mounted to this centering device, and the center 5 or 8 attached to the main spindle 3 of the main shaft unit 30 or the tailstock spindle 6 of the centering unit 10 is ground while being rotated to thereby effect centering.

The relative positional relationship between the grinding wheel and the main shaft unit 30 or the centering unit 10 in this device is the same as that in the rotary drive center device, so that when the main shaft unit 30 and the centering unit 10 are restored onto the base of the rotary drive center device, centering has been effected on the centers 5 and 8 of the units 10 and 30, with the centers being accurately aligned with the axis.

While in the above-described embodiments shown in FIGS. 1 through 10 a spring or an air cylinder device is used as the tailstock center urging means, it is also possible to replace them by a hydraulic device, an electromagnetic elastic force imparting device, a mechanical elastic force imparting device other than a spring, etc.

Further, as the main spindle rotary drive means or the tailstock spindle rotary drive means, it is possible to use, apart from the inner rotor type induction motor and the pulse motor, an electric motor of different structure operating on some other principle, such as an ultrasonic motor, an outer rotor type motor, or an axial gap type motor, a hydraulic motor, an air turbine, etc.

In the above-described center support grinding machine, the cylindrical workpiece 1 is not pressurized by the driving rubber roller during grinding to cause "partial wear" on the centers, so that wear or partial wear of the centers is not caused even after the machining of a large number of workpieces is conducted, whereby it is possible to maintain a satisfactory cylindricality of the machined cylindrical surface of the workpiece for a long period of time.

Further, the frequency of the center position adjustment and the center replacement, which require a lot of time, is reduced, and the running availability factor of the machine is improved, so that the operator can work more efficiently and handle a larger number of machines. Further, the service life of the centers is increased and the consumable store expenses are reduced, resulting in a reduction in manufacturing cost.

According to the center support grinding method of this invention, in the rough grinding step, rough grinding is performed on the workpiece while rotating the workpiece by the two centers, and in the subsequent finish grinding step, finish grinding is performed while rotating the workpiece by one center, with the other center being in a stationary state.

In the rough grinding step, in which the workpiece receives a large grinding resistance, no slippage occurs between the centers and the workpiece due to the two-center drive, so that generation of partial wear on the centers is restrained. In the finish grinding step, in which the grinding resistance is small, the center hole on one side of the workpiece is supported by a stationary center. The stationary center makes no rotating movement, and involves no rotation precision error of the workpiece due to the rotating movement, so that the finish grinding can be performed with so much the higher precision. Although slippage occurs between the stationary center and the workpiece in the finish grinding step, practically no partial wear occurs due to the small load.

In the above-mentioned grinding method, when the two centers are rotated in synchronism with each other by separate built-in motors, the two centers and the workpiece integrally make a synchronous rotation, and slippage, which leads to a partially worn stationary center, is eliminated, so that the partial wear preventing effect is further enhanced.

When the two centers are rotated by separate built-in motors, and the fixation of one center is effected by the stationary constraining force of the built-in motor, no misalignment of the stationary side center occurs, thereby achieving an improvement in coaxiality.

As described above, in the device of this invention, the main shaft unit is equipped with, a main spindle and a built-in type main spindle rotary drive means, and the tailstock unit is equipped with a tailstock spindle, or further, a tailstock spindle rotary drive means. And, an in-feed means, on which the main shaft unit and the tailstock unit are mounted, makes a swiveling motion, whereby the rotary drive center and the tailstock center are moved. Through this movement, the cylindrical workpiece held between the main spindle center and the tailstock spindle center and rotated makes an in-feed operation with respect to the grinding wheel.

In the construction of the apparatus of this invention, there is no need to provide means for transmitting torque from outside, such as a belt and a pulley, and the moment of inertia of the rotating portions serving to hold and rotate the workpiece, such as the motor rotors and spindles, is reduced. When the moment of inertia is small, the requisite (non-machining) time for stopping and starting rotation when attaching or detaching the workpiece is markedly reduced, thereby achieving an improvement in production efficiency.

Further, the apparatus of this invention can be made very compact and reduced in size and weight while maintaining the necessary and sufficient rigidity for the structures for workpiece retention, rotary drive, and in-feed. With this highly rigid, small, and light-weight construction, it is possible to rotate a minute workpiece and to feed it accurately, thus performing precision grinding.

As a result of making the apparatus of this invention compact, it has become possible to accommodate the structures for workpiece retention, rotary drive, and in-feed in a rectangular parallelepiped having a length of not more than 20 to 30 cm and a sectional dimension of not more than 6 cm×8 cm. If, in addition, the grinding wheel shaft system is further diminished in size, it is possible to realize a grinding machine that can be accommodated in a cube 20 to 30 cm on a side.

Further, due to the absence of an external torque transmitting means, the drive system is made compact and reduced in size, and so much the more space is available, so that there is less limitation regarding the arrangement space for the peripheral devices, such as a supply and discharge device for a minute workpiece, an in-process sizing device, etc., thereby realizing an efficient arrangement. This also leads to a reduction in non-machining time and an improvement in the operational reliability of the peripheral devices.

Further, due to the reduction in size and weight, it is possible to reduce the price of the grinding machine itself, and to reduce the requisite power and the maintenance cost.

Further, as a result of the reduction in the size and weight of the grinding machine, it is also possible to reduce the plant running cost for the plant facilities, air conditioning, etc. Further, when the grinding machine is out of order, instead of depending on the conventional in-field services, which involve a high cost and a long downtime, it is possible for the user to obtain a substitute from the maker for replacement, thereby recovering the failure in a short time and at low cost.

Further, by adopting the following arrangement, the mass of the portion moving integrally with the tailstock center is reduced, thereby making it possible to perform the operation of attaching and detaching the workpiece to and from the centers easily. That is, the tailstock spindle rotary drive means consists of an inner rotor type electric motor, the inner rotor thereof which is attached to the tailstock spindle, with the outer stator being fixed to the tailstock unit. And, when the tailstock spindle makes an axial movement, the rotor of the motor moves in the axial direction relative to the stator.

Further, by using a tailstock center urging means which also serves as the tailstock spindle axial movement means for moving the tailstock spindle in the axial direction, it is possible to further reduce the size and weight of the rotary drive center device.

Further, a tailstock center urging means is provided in the tailstock unit, and this tailstock unit is movable in the axial direction of the tailstock spindle by the spindle axial movement means, whereby the construction of the rotary drive center device is made simple and compact.

Further, the in-feed means holds the rotary drive center, the main spindle rotary drive means, and the tailstock center by an eccentric bearing decentered with respect to the rotary drive center and the tailstock center, and in-feed operation is made by swiveling of the eccentric bearing, whereby the structures for center retention, driving, and in-feed become substantially coaxial and are formed into a compact unit.

When the main spindle rotary drive means and the tailstock spindle rotary drive means are rotated in synchronism with each other, slippage between the centers and the center holes is completely eliminated, thereby further enhancing the partial wear preventing effect.

When at least one of the main spindle rotary drive means and the tailstock spindle rotary drive means is a rotary drive means having a stationary constraining force, it is possible to fix the spindle by the stationary constraining force, and no center misalignment occurs as in the case of the fixation by clamping or the like.

Further, when the in-feed means has an in-feed lever on which the rotary drive center, the main spindle rotary drive means, and the tailstock center are mounted, and in-feed operation is performed through swiveling of this in-feed lever, the in-feed amount is determined according to the ratio of the distance between the lever fulcrum and the center to the distance between the lever fulcrum and the in-feed drive portion, so that the in-feed speed can be easily controlled.

According to the method of this invention, a pair of centers are respectively attached to spindles, and centering is performed thereon through grinding by a grinding tool while rotating them, the cylindrical workpiece being rotated while being held by these centers in this mounting condition, so that the centering of the centers can be performed easily, efficiently, and accurately, thereby making it possible to realize a high-quality rotary drive for a workpiece.

Further, when one grinding tool is equipped with grinding surfaces for grinding a pair of centers opposed to each other, and the centers are simultaneously ground for centering by this grinding tool, there is no need to perform detachment of the tailstock center, mounting of a dedicated centering tool, etc., so that it is possible to perform the centering operation more efficiently.

What is claimed is:

1. A center support grinding machine, comprising:

a main shaft unit;

a main spindle rotatably retained in the main shaft unit;

a rotary drive center retained by the main spindle and adapted to be engaged with one center hole of a cylindrical workpiece;

main spindle rotary drive means built into the main shaft unit and adapted to rotate the main spindle;

a tailstock unit;

a tailstock spindle retained in the tailstock unit so as to be slidable in the axial direction;

a tailstock center retained by the tailstock spindle, arranged so as to be opposed to the rotary drive center in the same axis, and adapted to be engaged with the other center hole of the cylindrical workpiece to hold the cylindrical workpiece in cooperation with the rotary drive center;

tailstock center urging means for elastically urging the tailstock center toward the rotary drive center side to hold the cylindrical workpiece between the rotary drive center and the tailstock center; and in-feed means on which the rotary drive center, the main spindle rotary drive means, and the tailstock center are mounted and which moves the rotary drive center, the main spindle rotary drive means, and the tailstock center by a swiveling motion to thereby cause the cylindrical workpiece held between and rotated by the two centers to make an in-feed operation with respect to a grinding wheel.

2. A center support grinding machine according to claim 1, wherein the tailstock spindle is rotatably supported by the tailstock unit, and that it is further equipped with tailstock spindle rotary drive means built into the tailstock unit and adapted to rotate the tailstock spindle in the same direction as the main spindle.

3. A center support grinding machine according to claim 2, wherein the main spindle rotary drive means and the tailstock spindle rotary drive means are rotated in synchronism with each other.

4. A center support grinding machine according to claim 2, wherein at least one of the main spindle rotary drive means and the tailstock spindle rotary drive means has a stationary constraining force.

5. A center support grinding machine according to claim 2, wherein the tailstock spindle rotary drive means is an inner rotor type electric motor, an inner rotor of the motor being attached to the tailstock spindle, and an outer stator thereof being fixed to the tailstock unit so that the inner rotor of the motor moves in the axial direction with respect to the stator when the tailstock spindle moves in the axial direction.

6. A center support grinding machine according to claim 1, wherein the tailstock center urging means also serves as tailstock spindle axial movement means for moving the tailstock spindle in the axial direction.

7. A center support grinding machine according to claim 1, wherein a tailstock center urging means is provided in the tailstock unit, and the tailstock unit is movable in the axial direction of the tailstock spindle, moving in the axial direction of the tailstock spindle by the spindle axial movement means.

8. A center support grinding machine according to claim 1, wherein the in-feed means retains the rotary drive center, the main spindle rotary drive means, and the tailstock center by an eccentric bearing eccentrically arranged with respect to the rotary drive center and the tailstock center, and is adapted to make an in-feed operation through swiveling of the eccentric bearing.

9. A center support grinding machine according to claim 1, wherein the in-feed means has an in-feed lever on which the rotary drive center, the main spindle rotary drive means, and the tailstock center are mounted, the in-feed operation being made through swiveling of the in-feed lever.

* * * * *